US007184564B2

(12) United States Patent
Rosenthal

(10) Patent No.: US 7,184,564 B2
(45) Date of Patent: Feb. 27, 2007

(54) MULTI-PARAMETER HEARING AID

(75) Inventor: Joyce Rosenthal, Golden Valley, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 31 days.

(21) Appl. No.: 10/658,109

(22) Filed: Sep. 9, 2003

(65) Prior Publication Data

US 2004/0240693 A1 Dec. 2, 2004

Related U.S. Application Data

(60) Provisional application No. 60/474,744, filed on May 30, 2003.

(51) Int. Cl.
*H04R 25/00* (2006.01)

(52) U.S. Cl. ..... 381/322; 381/324

(58) Field of Classification Search ..... 381/312, 381/314, 315, 322, 324, 328, 329, 330, 60, 381/104

See application file for complete search history.

(56) References Cited

U.S. PATENT DOCUMENTS 4,739,512 A * 4/1988 Hartl et al. ..... 381/328
5,265,168 A * 11/1993 Schiess et al. ..... 381/324
5,271,063 A * 12/1993 d'Alayer de Costemore d'Arc ..... 381/104
5,852,668 A * 12/1998 Ishige et al. ..... 381/312
6,058,197 A 5/2000 Delage ..... 381/314
6,130,950 A * 10/2000 Martin ..... 381/312
6,175,635 B1 * 1/2001 Meyer et al. ..... 381/314
6,549,635 B1 * 4/2003 Gebert ..... 381/324
6,567,524 B1 * 5/2003 Svean et al. ..... 381/71.1
6,590,987 B2 7/2003 Delage ..... 381/315
6,937,738 B2 * 8/2005 Armstrong et al. ..... 381/312
2002/0094098 A1 7/2002 Delage ..... 381/315

* cited by examiner

*Primary Examiner*—Curtis Kuntz
*Assistant Examiner*—Brian Ensey
(74) *Attorney, Agent, or Firm*—Schwegman, Lundberg, Woessner & Kluth, P.A.

(57) ABSTRACT

A hearing aid according to an embodiment of the present invention includes a parameter-select device to select one of several parameters to be adjusted and a parameter-adjust device to adjust the parameter-selected by the parameter-select device. Another hearing aid according to an embodiment of the present invention includes an entire set of pre-programmed parameters to be selected for a given position of the parameter-select device.

49 Claims, 7 Drawing Sheets

MULTI-PARAMETER HEARING AID

CROSS-REFERENCE TO RELATED APPLICATION(S)

This application claims the benefit of U.S. Provisional Application No. 60/474,744, filed on May 30, 2003, under 35 U.S.C. § 119(e).

FIELD OF THE INVENTION

The present invention relates generally to hearing aids, and more particularly, to a multi-parameter hearing aid.

BACKGROUND

Hearing aids have parameters which, when adjusted appropriately, can improve the hearing aid performance for a specific person in specific environments. Such adjustable parameters include, for example, gain, maximum output, and compression ratio (the amount by which louder sounds should be reduced). Control of these parameters via the adjustment of potentiometers was, at one time, considered the industry standard.

Today roughly half the hearing aids sold in the U.S. are made using digital circuitry, and computer-control of the hearing aid's adjustable parameters is the norm. Computer programming of digital hearing aids allows for increased flexibility and precision in setting parameters. Furthermore, the number of parameters that can be adjusted is not constrained by the physical dimensions of the hearing aid. However, many users/dispensers of digital hearing aids do not have the computer access needed to adjust these devices. These users would be better served by potentiometer-controlled digital hearing aids. Currently, the small size of the hearing aid limits the number of potentiometers (and subsequently the number of parameters) to just two or three. There exists a need to increase the number of parameters than can be adjusted by potentiometer, rather than computer, control.

SUMMARY

The present subject matter addresses the foregoing need and others not stated expressly herein. In varying embodiments, a hearing aid includes a 'parameter-select' device to select one of several parameters to be adjusted, and a 'parameter-adjust' device to adjust the parameter selected by the 'parameter-select' device. Another embodiment of the hearing includes an entire set of pre-programmed parameters to be selected for a given position of the parameter-select device Other embodiments of the hearing aid includes a memory select device to select first parameters in a first or second parameters in a memory device. Other embodiments are provided in the detailed description and will be discernable to those of skill in the art upon reading and understanding the present subject matter.

This Summary is an overview of some of the teachings of the present application and not intended to be an exclusive or exhaustive treatment of the present subject matter. Further details about the present subject matter are found in the detailed description and appended claims. Other aspects of the invention will be apparent to persons skilled in the art upon reading and understanding the following detailed description and viewing the drawings that form a part thereof, each of which are not to be taken in a limiting sense.

The scope of the present invention is defined by the appended claims and their legal equivalents.

DETAILED DESCRIPTION

In the following detailed description of embodiments of the present invention, reference is made to the accompanying drawings which form a part hereof, and in which are shown by way of illustration, specific embodiments in which the subject matter may be practiced. These embodiments are described in sufficient detail to enable those skilled in the art to practice the subject matter, and it is to be understood that other embodiments may be utilized and that process, electrical or mechanical changes may be made without departing from the scope of the present disclosure. It should be noted that references to "an", "one", or "various" embodiments in this disclosure are not necessarily to the same embodiment, and such references contemplate more than one embodiment.

Figure 1A:
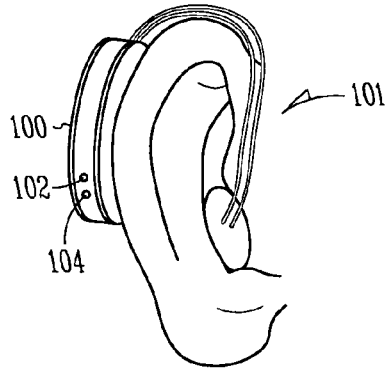
FIGS. 1A, 1B, and 1C each show a hearing aid housing according to an embodiment of the present invention.
Figure 1B:
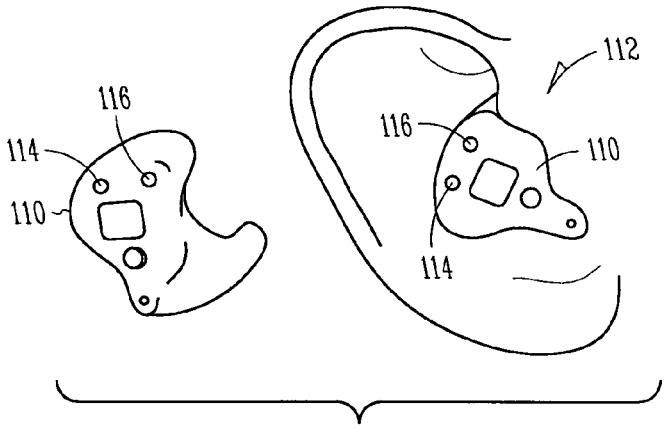
Figure 1C:
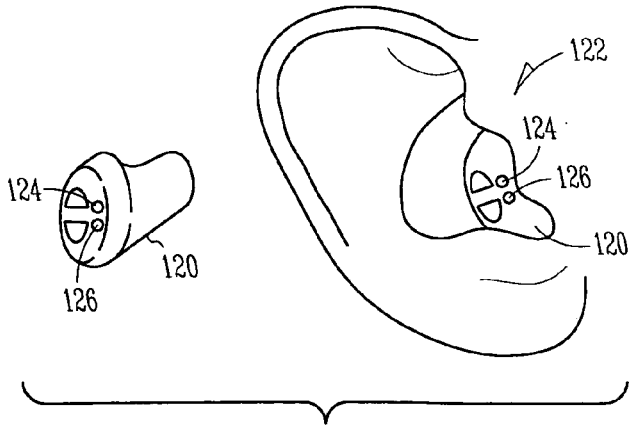

FIG. 1A shows a hearing aid housing 100 adapted to be worn behind an auricle of an ear 101 according to an embodiment of the present invention. A parameter-select device 102 and a parameter-adjust device 104 are located on an external surface of the hearing aid housing 100. FIG. 1B shows another embodiment where a hearing aid housing 110 is adapted for placement in the concha of an ear 112. A parameter-select device 114 and a parameter-adjust device 116 are located on an external surface of the hearing aid housing 110. In another embodiment of the present invention shown in FIG. 1C, a hearing aid housing 120 is adapted for placement in deeper in the auditory canal of an ear 122. A parameter-select device 124 and a parameter-adjust device 126 are located on an external surface of the hearing aid housing 120. Each of the hearing aid housings 100, 110, and 120 is supported by an ear according to alternate embodiments of the present invention. The parameter-select devices 102, 114, and 124 are the same and will be referred to with the reference numeral 102. The parameter-adjust devices 104, 116, and 126 are the same and will be referred to with the reference numeral 104.

In one embodiment, the parameter-select device 102 is a parameter-select potentiometer 102 and the parameter-adjust device 104 is a continuous digital potentiometer 104. Other types of devices may be used for the parameter-select device and the parameter-adjust device according to varying embodiments. In one embodiment, the parameter-select potentiometer 102 comprises a Resistance Technology Incorporated Trimmer Model 17 and the continuous digital potentiometer 104 comprises a Microtronic Volume Control Model DCU 93. Other potentiometers may be used for the parameter-select potentiometer 102 and the continuous digital potentiometer 104 without departing from the present teachings.

Figure 2:
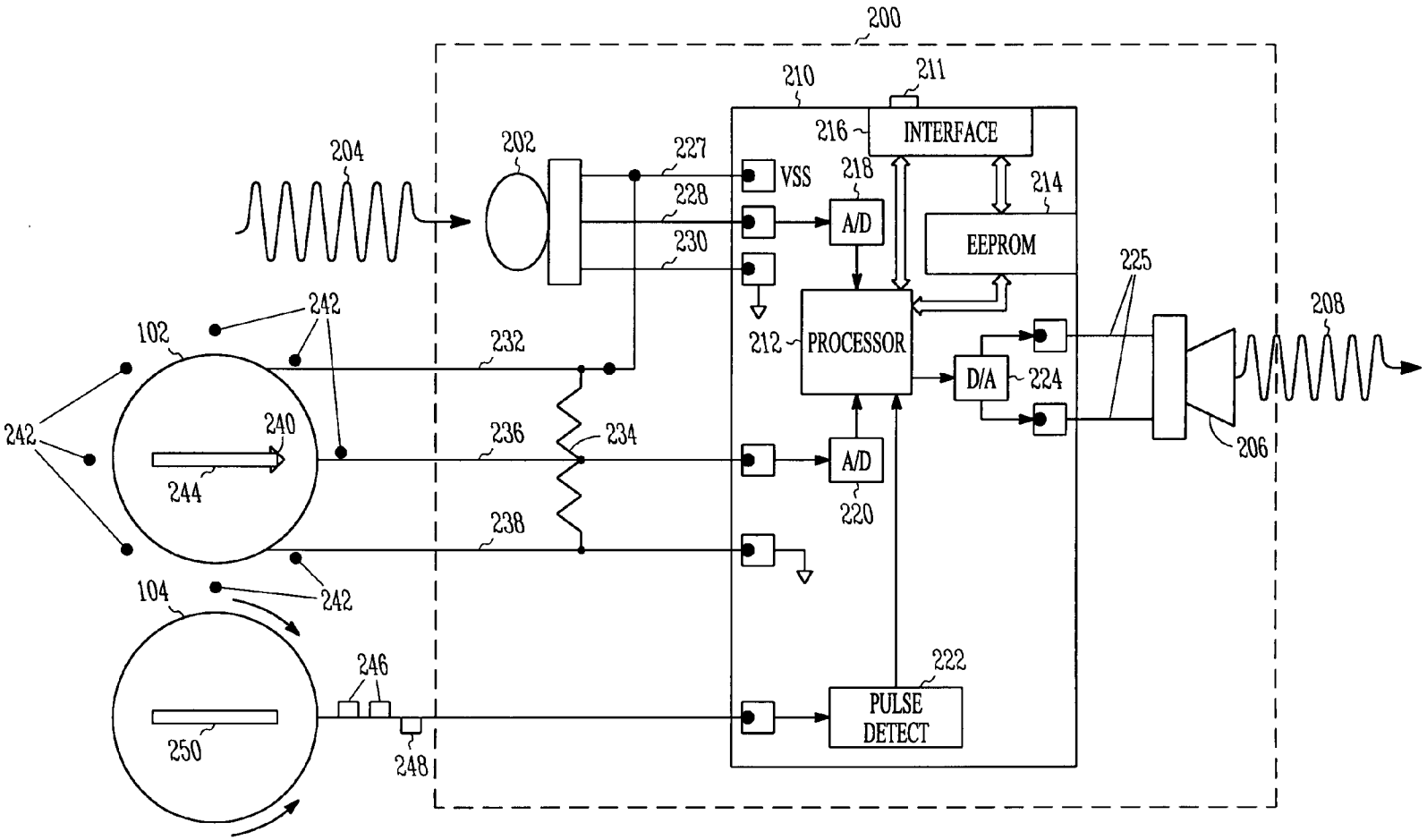
FIG. 2 is a block diagram of a circuit in a hearing aid according to an embodiment of the present invention.

A block diagram of a circuit 200 in the hearing aid housing 100 is shown in FIG. 2 according to an embodiment of the present invention. The circuit 200 is coupled to the parameter-select potentiometer 102 and the continuous digital potentiometer 104 shown in FIGS. 1A–1C. The circuit 200 includes a microphone 202 to receive sound 204 and to generate an input signal based on the sound 204. The circuit 200 also includes a receiver 206 to transmit sound 208 based on an output signal, and a digital signal processing circuit 210 coupled between the microphone 202 and the receiver 206 to process the input signal from the microphone 202 and the output signal to be transmitted to the receiver 206 according to a number of parameters. The parameter-select potentiometer 102 is used to select one of the parameters to be adjusted, and the continuous digital potentiometer 104 is used to adjust the selected parameter.

The digital signal processing circuit 210 includes a program connection 211 to receive instructions to be programmed into the digital signal processing circuit 210, a processor 212, an EEPROM 214 coupled to the processor 212, and an interface 216 coupled to the program connection 211, the processor 212, and the EEPROM 214 to relay the instructions to the EEPROM 214 and the processor 212. A first analog-to-digital converter 218 is coupled between the microphone 202 and the processor 212 to convert the input signal from the microphone 202 into a digital signal to be received by the processor 212. A second analog-to-digital converter 220 is coupled between the parameter-select potentiometer 102 and the processor 212 to convert an analog signal from the parameter-select potentiometer 102 into a digital signal to be received by the processor 212 to select one of the parameters. A pulse detect circuit 222 is coupled between the continuous digital potentiometer 104 and the processor 212 to detect pulses generated by the continuous digital potentiometer 104 and to couple a signal to the processor 212 to indicate the detected pulses. A digital-to-analog converter 224 is coupled between the processor 212 and the receiver 206 to convert a digital signal from the processor 212 to the output signal to be received by the receiver 206. The receiver 206 includes two terminals 225 coupled to the digital-to-analog converter 224 to receive the output signal.

The microphone 202 includes a high terminal 227 coupled to a supply voltage Vss, a middle terminal 228 to couple the input signal to the first analog-to-digital converter 218, and a low terminal 230 coupled to a ground voltage reference.

The parameter-select potentiometer 102 includes a high terminal 232 coupled to the high terminal 227 of the microphone 202, the supply voltage Vss, and a first end of a resistor 234. A middle terminal 236 of the parameter-select potentiometer 102 is in movable contact with the resistor 234 and is coupled to the second analog-to-digital converter 220. A low terminal 238 of the parameter-select potentiometer 102 is coupled to a second end of the resistor 234 and to the ground voltage reference. The parameter-select potentiometer 102 is rotated to move the middle terminal 236 along the resistor 234 to generate an analog signal at the middle terminal 236. The analog signal indicates the position of the parameter-select potentiometer 102, and is converted into a digital signal by the second analog-to-digital converter 220.

The parameter-select potentiometer 102 includes a visible arrow 240 pointing toward the selected parameter, each parameter being represented by a visible color-coded dot 242. The color-coded dots 242 are fixed in relation to the parameter-select potentiometer 102 and represent the parameters including a low cut filter frequency LC, a high cut filter frequency HC, a compression ratio CR, a threshold knee TK, a gain control GC, an output parameter AO, full-on parameters, and so called 'best fit' parameters. The parameter-select potentiometer 102 is rotated to indicate one of the color-coded dots 242 with the arrow 240. The parameter-select potentiometer 102 also includes an indentation 244 shaped to receive a screwdriver to rotate the parameter-select potentiometer 102.

The continuous, digital potentiometer 104 produces positive pulses 246 when rotated in a clockwise direction and produces negative pulses 248 when rotated in a counter-clockwise direction. One full rotation of the continuous digital potentiometer 104 corresponds to an entire range of values for a parameter. The continuous, digital potentiometer 104 further includes an indentation 250 shaped to receive a screwdriver to rotate the continuous digital potentiometer 104.

Figure 3:
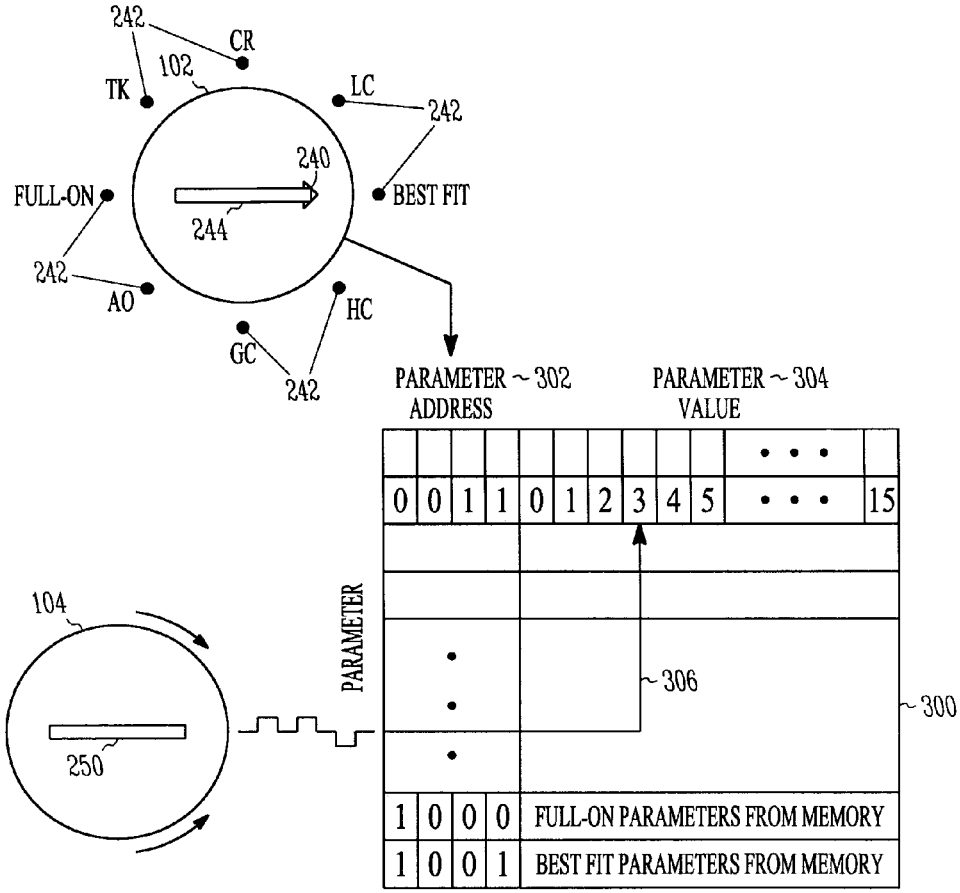
FIG. 3 is a block diagram of a memory map in a hearing aid according to an embodiment of the present invention.

One way to change the parameters based on the settings of the parameter-select potentiometer 102 and the continuous digital potentiometer 104 is to employ a memory map. A memory map 300 is shown in FIG. 3 according to an embodiment of the present invention. The memory map 300 is shown in relation to the parameter-select potentiometer 102 and the continuous digital potentiometer 104. The color-coded dots 242 are also shown with the symbols indicating the parameters. The memory map 300 is stored in the EEPROM 214 and includes a number of four-bit addresses 302, each four-bit address 302 to address one of the parameters. The memory map 300 also includes a range of values 304 between a high value and a low value for each of the parameters. The EEPROM 214 stores a separate pointer for each of the parameters, each pointer to point to a value in the memory map 300 for a respective parameter. The processor 212 processes the input signal and the output signal according to values in the memory map 300 pointed to by the stored pointers. The pulse detect circuit 222 generates a signal to be used by the processor 212 to modify the pointers. A pointer 306 is shown schematically in FIG. 3. The digital signal from the second analog-to-digital converter 220 is converted into the four-bit address 302 associated with the selected parameter by the processor 212.

The memory map is implemented by software stored in the EEPROM 214 according to an embodiment of the present invention. The memory map is implemented in hardware such as dedicated registers in other embodiments of the present invention. Varying embodiments may include combinations of hardware and software to achieve the map as provided herein.

When the parameter-select potentiometer 102 is rotated to point the arrow 240 toward full-on parameters FULL-ON, the processor 212 modifies the pointers stored in the EEPROM 214 to point to full-on values in the memory map 300, the full-on values comprising the low cut filter frequency LC set for maximum gain, the high cut filter frequency HC set for maximum gain, the compression ratio CR set to 1:1, the threshold knee TK set to 45 dBSPL, and the output parameter AO set to maximum. The pointers are modified according to full-on pointer data stored in the EEPROM 214.

When the parameter-select potentiometer 102 is rotated to point the arrow 240 toward best fit parameters BEST FIT, the processor 212 modifies the pointers stored in the EEPROM 214 to point to best fit values in the memory map 300. The best fit values are selected according to audiometric data or data for a typical user, and the pointers are modified according to best fit pointer data stored in the EEPROM 214.

Figure 4A:
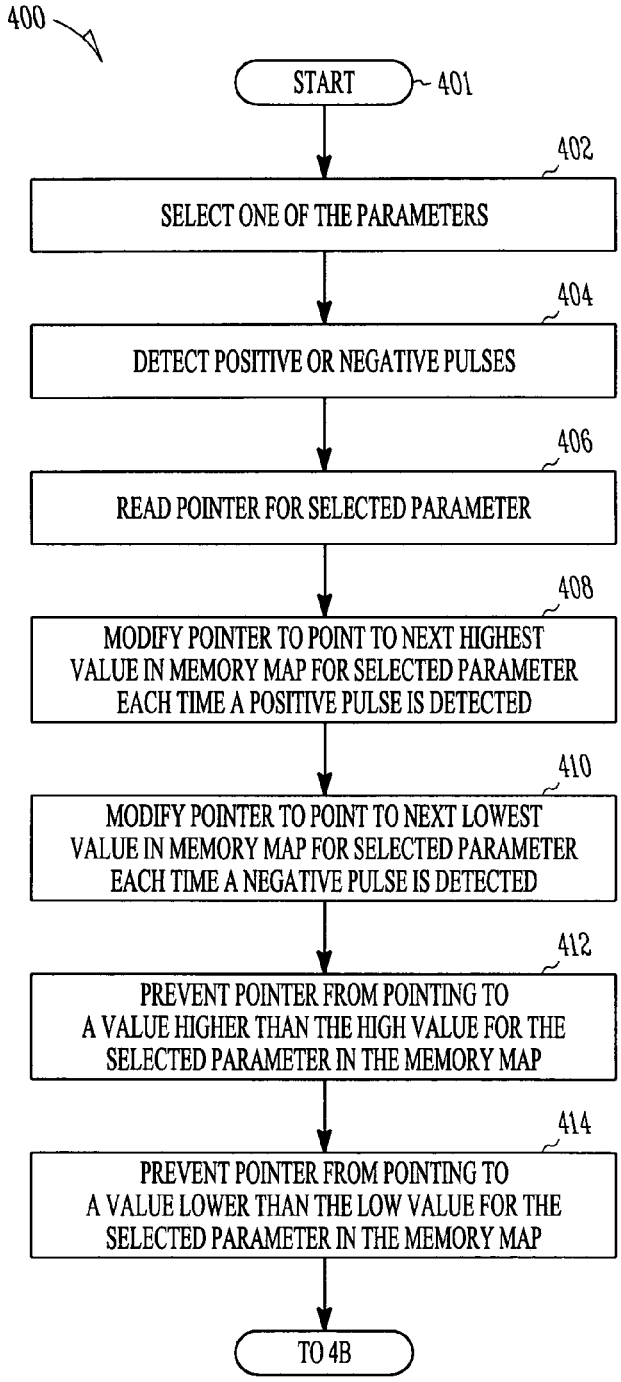
FIGS. 4A and 4B are a flowchart of a method of operating a hearing aid according to an embodiment of the present invention.
Figure 4B:
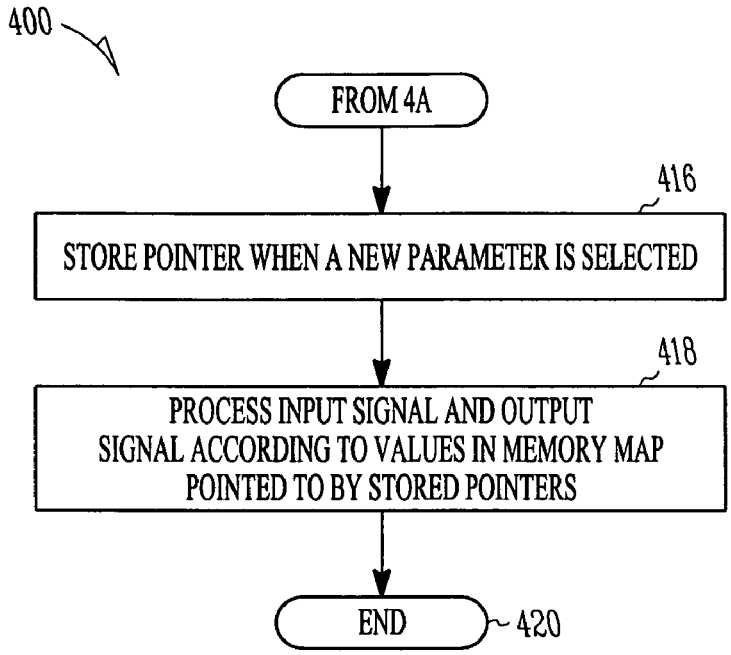

The circuit 200 is operated according to a method 400 shown in a flowchart in FIGS. 4A and 4B according to an embodiment of the present invention. The method 400 starts in 401 and the parameter-select potentiometer 102 is rotated to select one of the parameters in 402. Positive pulses or negative pulses or both positive pulses and negative pulses generated by positive or negative rotations of the continuous digital potentiometer 104 are detected by the pulse detect circuit 222 in 404. The pointer for the selected parameter is read in 406 and modified to point to a next highest value in 408 each time a positive pulse is detected and the pointer is modified to point to a next lowest value in 410 each time a negative pulse is detected. The pointer is prevented from pointing to a value higher than the high value in 412, and the pointer is prevented from pointing to a value lower than the low value in 414. The pointer is stored in 416 when the parameter-select potentiometer 102 is rotated to select a new parameter. The processor 212 processes the input signal and the output signal according to values in the memory map 300 pointed to by the stored pointers in 418 and the method 400 ends in 420.

Other systems for adjusting the parameters based on the settings of the parameter-select potentiometer 102 and the continuous digital potentiometer 104 are possible. In one embodiment, the settings of one or more of the potentiometers are used to calculate one or more parameter values by processor 212 or by other hardware and software.

Figure 5A:
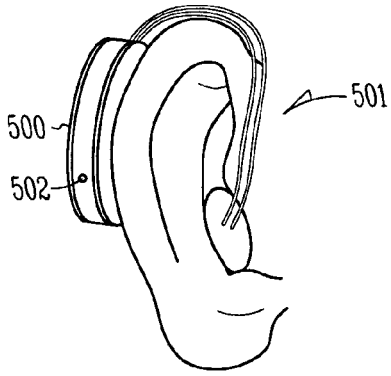
FIGS. 5A, 5B, and 5C each show a hearing aid housing according to an embodiment of the present invention.

Other variations and combinations of potentiometers, hardware, and software are possible without departing from the scope of the present teachings. For example, a hearing aid housing 500 adapted to be worn behind an auricle of an ear 501 is shown in FIG. 5A according to an embodiment of the present invention. A memory select device 502 is located on an external surface of the hearing aid housing 500. In another embodiment of the present invention shown in FIG. 1B, a hearing aid housing 510 is adapted for placement in a concha of an ear 512. A memory select device 514 is located on an external surface of the hearing aid housing 510. In another embodiment of the present invention shown in FIG. 1C, a hearing aid housing 520 is adapted to be placed in an auditory canal of an ear 522. A parameter-select device 524 is located on an external surface of the hearing aid housing 520. Each of the hearing aid housings 500, 510, and 520 is supported by an ear according to alternate embodiments of the present invention. The memory select devices 502, 514, and 524 are the same and will be referred to with the reference numeral 502.

In one embodiment of the present invention, the memory select device 502 is a pushbutton toggle switch 502 to generate a pulse when pushed. Other types of devices may be used for the memory select device.

Figure 5B:
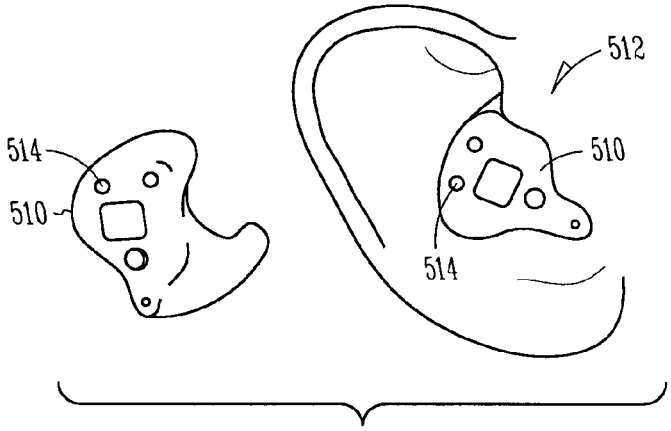
Figure 5C:
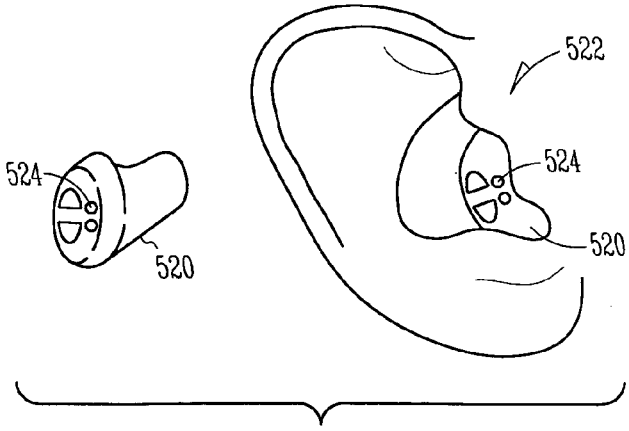
Figure 6:
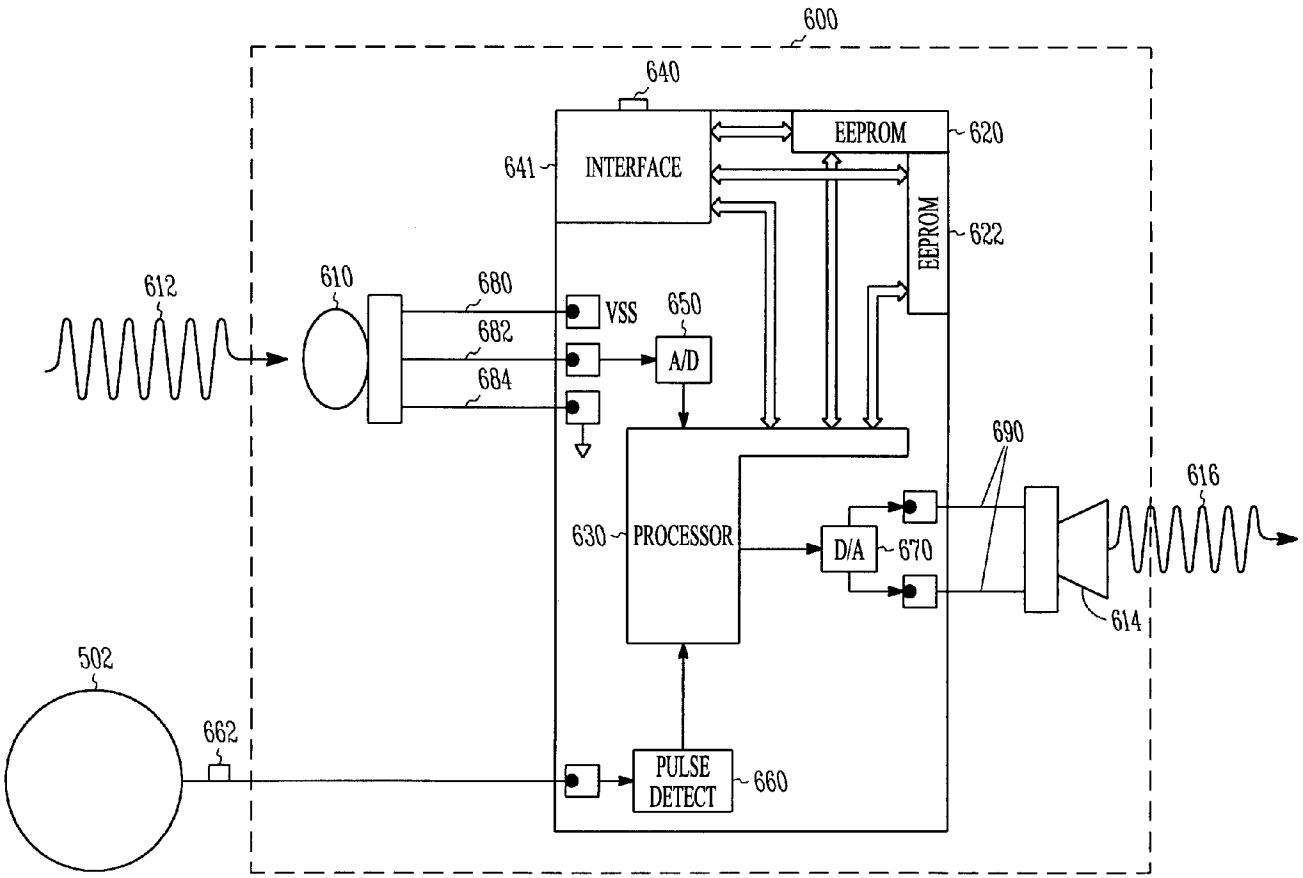
FIG. 6 is a block diagram of a circuit in a hearing aid according to an embodiment of the present invention.

A block diagram of a circuit 600 in the hearing aid housing 500 is shown in FIG. 6 according to an embodiment of the present invention. The circuit 600 is coupled to the toggle switch 502 shown in FIGS. 5A, 5B, and 5C. The circuit 600 includes a microphone 610 to receive sound 612 and to generate an input signal based on the sound 612. The circuit 600 also includes a receiver 614 to transmit sound 616 based on an output signal. The circuit 600 has a first EEPROM 620 to store first parameters and a second EEPROM 622 to store second parameters. The toggle switch 502 is used to select the first parameters in the first EEPROM 620 or the second parameters in the second EEPROM 622. The circuit 600 has a processor 630 coupled between the microphone 610, the receiver 614, the first EEPROM 620, and the second EEPROM 622 to process the input signal from the microphone 610 and the output signal to be transmitted to the receiver 614 according to the first parameters or the second parameters. The circuit 600 includes digital circuitry.

The circuit 600 also includes a program connection 640 to receive instructions to be programmed into the processor 630 and an interface 642 coupled to the program connection 640, the first EEPROM 620, and the second EEPROM 622 to relay the instructions to the first EEPROM 620 and the second EEPROM 622. The processor 630 is coupled to the interface 642, the first EEPROM 620, and the second EEPROM 622 to receive the instructions. An analog-to-digital converter 650 is coupled between the microphone 610 and the processor 630 to convert the input signal from the microphone 610 into a digital signal to be received by the processor 630. A pulse detect circuit 660 is coupled between the toggle switch 502 and the processor 630 to detect a pulse 662 generated by the toggle switch 502 and to couple a signal to the processor 630 indicating the detected pulse 662. A digital-to-analog converter 670 is coupled between the processor 630 and the receiver 614 to convert a digital signal from the processor 630 to the output signal to be received by the receiver 614.

The microphone 610 includes a high terminal 680 coupled to a supply voltage, a middle terminal 682 to couple the input signal to the analog-to-digital converter 650, and a low terminal 684 coupled to a ground voltage reference. The receiver 614 includes two terminals 690 coupled to the digital-to-analog converter 670 to receive the output signal.

The first EEPROM 620 includes full-on parameters to cause the processor 630 to process the input signal from the microphone 610 and the output signal to be transmitted to the receiver 614 according to the full-on parameters when the first EEPROM 620 is selected, the full-on parameters comprising a low cut filter frequency set for maximum gain, a high cut filter frequency set for maximum gain, a compression ratio set to 1:1, a threshold knee set to 45 dBSPL, and an output parameter set to maximum.

The second EEPROM 622 includes best fit parameters to cause the processor 630 to process the input signal from the microphone 610 and the output signal to be transmitted to the receiver 614 according to the best fit parameters when the second EEPROM 622 is selected, the best fit parameters having been selected according to audiometric data or data for a typical user.

Although the present invention has been shown in several embodiments in relation to typical human ears and hearing, it is understood that these teachings may be applied in other hearing assistance devices, atypical ear shapes and non-human applications.

Although the present invention has been described in conjunction with the foregoing specific embodiments, many alternatives, variations, and modifications will be apparent to those of ordinary skill in the art. Other such alternatives, variations, and modifications may fall within the scope of the following appended claims or within the legal equivalents of the claims.

What is claimed is:

1. A hearing aid adapted to be worn in or about an ear, comprising:

a hearing aid housing;

a microphone to receive sound and to generate an input signal based on the sound;

a signal processing circuit housed by the housing and receiving the input signal from the microphone, the signal processing circuit to process the input signal and produce an output signal based on a plurality of signal processing parameters;

a receiver in the housing to transmit sound based on the output signal;

a parameter-select device accessible to be manipulated externally from the housing to manually select a parameter of the plurality of signal processing parameters to be adjusted; and a parameter-adjust device accessible to be manipulated externally from the housing to manually adjust the parameter selected by the parameter-select device.

2. The hearing aid of claim 1, further comprising wherein the housing is adapted to be worn behind an ear.

3. The hearing aid of claim 1, further comprising wherein the housing is adapted to be positioned in a concha of an ear.

4. The hearing aid of claim 1, further comprising wherein the housing is adapted to be positioned in an auditory canal of an ear.

5. The hearing aid of claim 1, further comprising wherein the parameter-select device comprises a potentiometer located about an external surface of the housing.

6. The hearing aid of claim 1, further comprising wherein the parameter-adjust device comprises a potentiometer located about an external surface of the housing.

7. The hearing aid of claim 1, further comprising wherein:

the parameter-select device comprises a Resistance Technology Incorporated Trimmer Model 17 located about an external surface of the housing; and the parameter-adjust device comprises a Microtronic Volume Control Model DCU 93 located on an external surface of the housing.

8. The hearing aid of claim 1, wherein the signal processing circuit comprises a digital signal processing circuit.

9. The hearing aid of claim 1, wherein the signal processing circuit comprises:

a program connection to receive instructions to be programmed into the signal processing circuit;

a processor;

a memory device coupled to the processor;

an interface coupled to the program connection, the processor, and the memory device to relay the instructions to the memory device and the processor;

a first analog-to-digital converter coupled between the microphone and the processor to convert the input signal from the microphone into a digital signal to be received by the processor; and a digital-to-analog converter coupled between the processor and the receiver to convert a digital signal from the processor to the output signal to be received by the receiver.

10. The hearing aid of claim 9, wherein the signal processing circuit further comprises a second analog-to-digital converter coupled between the parameter-select device and the processor to convert an analog signal from the parameter-select device into a digital signal to be received by the processor to select one of the parameters.

11. A hearing aid adapted to be worn in or about an ear, comprising:

a hearing aid housing;

a microphone to receive sound and to generate an input signal based on the sound;

a signal processing circuit housed by the housing and receiving the input signal from the microphone, the signal processing circuit to process the input signal and produce an output signal based on a plurality of signal processing parameters;

a receiver in the housing to transmit sound based on the output signal;

a parameter-select device accessible externally from the housing to select a parameter of the plurality of signal processing parameters to be adjusted; and a parameter-adjust device accessible externally from the housing to adjust the parameter selected by the parameter-select device, wherein the signal processing circuit comprises:

a program connection to receive instructions to be programmed into the signal processing circuit;

a processor;

a memory device coupled to the processor;

an interface coupled to the program connection, the processor, and the memory device to relay the instructions to the memory device and the processor;

a first analog-to-digital converter coupled between the microphone and the processor to convert the input signal from the microphone into a digital signal to be received by the processor; and a digital-to-analog converter coupled between the processor and the receiver to convert a digital signal from the processor to the output signal to be received by the receiver, wherein the signal processing circuit further comprises a second analog-to-digital converter coupled between the parameter-select device and the processor to convert an analog signal from the parameter-select device into a digital signal to be received by the processor to select one of the parameters, and wherein the signal processing circuit further comprises a pulse detect circuit coupled between the parameter-adjust device and the processor to detect pulses generated by the parameter-adjust device and to couple a signal to the processor to indicate the detected pulses.

12. The hearing aid of claim 11, wherein:

the memory device comprises an EEPROM;

the microphone comprises a high terminal coupled to a supply voltage, a middle terminal to couple the input signal to the first analog-to-digital converter, and a low terminal coupled to a ground voltage reference; and the receiver comprises two terminals coupled to the digital-to-analog converter to receive the output signal.

13. The hearing aid of claim 12, wherein the parameter-select device comprises a parameter-select potentiometer comprising:

a high terminal coupled to the high terminal of the microphone, the supply voltage, and a first end of a resistor, a middle terminal that is in movable contact with the resistor and is coupled to the second analog-to-digital converter, and a low terminal coupled to a second end of the resistor and to the ground voltage reference, the parameter-select potentiometer to be rotated such that a voltage at the middle terminal of the parameter-select potentiometer will indicate its position;

a visible arrow pointing toward the selected parameter, each parameter being represented by a visible color-coded dot, the color-coded dots being fixed in relation to the parameter-select potentiometer, the color-coded dots to represent parameters comprising, respectively, a low cut filter frequency, a high cut filter frequency, a compression ratio, a threshold knee, a gain control, an output parameter, full-on parameters, and best fit parameters, the parameter-select potentiometer to be rotated to indicate one of the color-coded dots with the arrow; and an indentation shaped to receive a screwdriver, the screwdriver to rotate the parameter-select potentiometer.

14. A hearing aid adapted to be worn in or about an ear, comprising:

a hearing aid housing;

a microphone to receive sound and to generate an input signal based on the sound;

a signal processing circuit housed by the housing and receiving the input signal from the microphone, the signal processing circuit to process the input signal and produce an output signal based on a plurality of signal processing parameters;

a receiver in the housing to transmit sound based on the output signal;

a parameter-select device accessible externally from the housing to select a parameter of the plurality of signal processing parameters to be adjusted; and a parameter-adjust device accessible externally from the housing to adjust the parameter selected by the parameter-select device, wherein the parameter-adjust device comprises a continuous digital potentiometer to produce positive pulses when rotated in a positive direction and to produce negative pulses when rotated in a negative direction, the continuous digital potentiometer being coupled to a pulse detect circuit in the signal processing circuit and one full rotation of the continuous digital potentiometer corresponds to an entire range of values for a parameter.

15. The hearing aid of claim 14, the continuous digital potentiometer further comprising an indentation shaped to receive a screwdriver, the screwdriver to rotate the continuous digital potentiometer.

16. A hearing aid adapted to be worn in or about an ear, comprising:

a hearing aid housing;

a microphone to receive sound and to generate an input signal based on the sound;

a signal processing circuit housed by the housing and receiving the input signal from the microphone, the signal processing circuit to process the input signal and produce an output signal based on a plurality of signal processing parameters;

a receiver in the housing to transmit sound based on the output signal;

a parameter-select device accessible externally from the housing to select a parameter of the plurality of signal processing parameters to be adjusted; and a parameter-adjust device accessible externally from the housing to adjust the parameter selected by the parameter-select device, wherein the signal processing circuit comprises:

a program connection to receive instructions to be programmed into the signal processing circuit;

a processor;

a memory device coupled to the processor;

an interface coupled to the program connection, the processor, and the memory device to relay the instructions to the memory device and the processor;

a first analog-to-digital converter coupled between the microphone and the processor to convert the input signal from the microphone into a digital signal to be received by the processor; and a digital-to-analog converter coupled between the processor and the receiver to convert a digital signal from the processor to the output signal to be received by the receiver, the hearing aid further comprising a memory map stored in the memory device comprising a plurality of four-bit addresses, each four-bit address to address one of the parameters, the memory map further comprising a range of values between a high value and a low value for each parameter, the parameters comprising a low cut filter frequency, a high cut filter frequency, a compression ratio, a threshold knee, a gain control, and an output parameter.

17. The hearing aid of claim 16, further comprising wherein:

the parameter-select device comprises a parameter-select potentiometer and the second analog-to-digital converter coupled between the parameter-select potentiometer and the processor is coupled to convert an analog signal from the parameter-select potentiometer into a digital signal to be converted by the processor into a selected four-bit address in the memory map to address one of the parameters selected by the parameter-select potentiometer;

the pulse detect circuit is coupled to generate a signal to be used by the processor to modify a pointer, the pointer being stored in the memory device to point to a value in the memory map for the parameter associated with the selected four-bit address, the processor to modify the pointer to point to a next highest value each time a positive pulse is detected and to modify the pointer to point to a next lowest value each time a negative pulse is detected, the pointer being prevented from pointing to a value higher than the high value and the pointer being prevented from pointing to a value lower than the low value, the processor to store the pointer when a new parameter is selected by the parameter-select potentiometer; and the memory device is structured to store a separate pointer for each of the parameters and the processor is structured to process the input signal and the output signal according to values in the memory map pointed to by the stored pointers.

18. The hearing aid of claim 17, further comprising wherein when the parameter-select potentiometer is rotated to indicate full-on parameters, the processor is structured to modify the pointers stored in the memory device to point to full-on values in the memory map, the full-on values comprising the low cut filter frequency set for maximum gain, the high cut filter frequency set for maximum gain, the compression ratio set to 1:1, the threshold knee set to 45 dBSPL, and the output parameter set to maximum, the pointers to be modified according to full-on pointer data stored in the memory device.

19. The hearing aid of claim 17, further comprising wherein when the parameter-select potentiometer is rotated to indicate best fit parameters, the processor is structured to modify the pointers stored in the memory device to point to best fit values in the memory map, the best fit values having been selected according to audiometric data or data for a typical user, the pointers to be modified according to best fit pointer data stored in the memory device.

20. The hearing aid of claim 16, further comprising wherein the memory map is implemented in dedicated registers in the memory device.

21. A method of operating a hearing aid adapted to be worn in or about an ear, the method comprising:

receiving sound in a microphone in a hearing aid housing and generating an input signal based on the sound;

processing the input signal into an output signal in a signal processing circuit coupled to the microphone in the housing according to a plurality of parameters;

generating sound from the output signal in a receiver coupled to the signal processing circuit in the housing;

selecting one of the parameters with a parameter-select device on an external surface of the housing; and adjusting the selected parameter with a parameter-adjust device on an external surface of the housing.

22. The method of claim 21 wherein selecting comprises rotating a parameter-select potentiometer on an external surface of the housing to one of a plurality of positions.

23. A method of operating a hearing aid adapted to be worn in or about an ear, the method comprising:

receiving sound in a microphone in a hearing aid housing and generating an input signal based on the sound;

processing the input signal into an output signal in a signal processing circuit coupled to the microphone in the housing according to a plurality of parameters;

generating sound from the output signal in a receiver coupled to the signal processing circuit in the housing;

selecting one of the parameters with a parameter-select device on an external surface of the housing; and adjusting the selected parameter with a parameter-adjust device on an external surface of the housing, wherein selecting comprises rotating a parameter-select potentiometer on an external surface of the housing to one of a plurality of positions, and wherein selecting further comprises rotating the parameter-select potentiometer to point a visible arrow on the parameter-select potentiometer toward one of a plurality of color-coded dots, the color-coded dots to represent parameters comprising, respectively, a low cut filter frequency, a high cut filter frequency, a compression ratio, a threshold knee, a gain control, an output parameter, full-on parameters, and best fit parameters.

24. A method of operating a hearing aid adapted to be worn in or about an ear, the method comprising:

receiving sound in a microphone in a hearing aid housing and generating an input signal based on the sound;

processing the input signal into an output signal in a signal processing circuit coupled to the microphone in the housing according to a plurality of parameters;

generating sound from the output signal in a receiver coupled to the signal processing circuit in the housing;

selecting one of the parameters with a parameter-select device on an external surface of the housing; and adjusting the selected parameter with a parameter-adjust device on an external surface of the housing, wherein adjusting the selected parameter comprises:

rotating a continuous digital potentiometer in a first direction to generate first pulses;

rotating the continuous digital potentiometer in a second direction to generate second pulses; and detecting the pulses in a pulse detect circuit coupled to indicate the pulses to the signal processing circuit.

25. The method of claim 24, wherein the detecting the pulses in a pulse detect circuit further comprises modifying a pointer for the selected parameter based on a number of first pulses and a number of second pulses detected, the pointer for the selected parameter to point to a value of the selected parameter in a map of values.

26. The method of claim 24, wherein the detecting the pulses in the pulse detect circuit further comprises modifying a pointer for the new parameter based on a number of first pulses and a number of second pulses detected, the pointer to point to a value of the new parameter in the map of values.

27. A method of operating a hearing aid adapted to be worn in or about an ear, the method comprising:

receiving sound in a microphone in a hearing aid housing and generating an input signal based on the sound;

processing the input signal into an output signal in a signal processing circuit coupled to the microphone in the housing according to a plurality of parameters;

generating sound from the output signal in a receiver coupled to the signal processing circuit in the housing;

selecting one of the parameters with a parameter-select device on an external surface of the housing; and adjusting the selected parameter with a parameter-adjust device on an external surface of the housing, wherein selecting one of the parameters further comprises selecting a four-bit address stored in a memory map in an EEPROM with the parameter-select device, the four-bit address associated with one of the parameters;

wherein adjusting the selected parameter further comprises modifying a pointer stored in the EEPROM for the selected parameter with the parameter-adjust device, the pointer to point to a value in the memory map associated with the four-bit address for the selected parameter, each parameter being associated with a range of values between a high value and a low value; and further comprising storing a pointer in the EEPROM for each parameter, each pointer to point to a value in the memory map for a respective parameter that is used by the signal processing circuit to process the input signal into the output signal.

28. The method of claim 27, wherein selecting one of the parameters further comprises:

moving a terminal of a parameter-select potentiometer along a resistor coupled between a supply voltage and a ground voltage reference to generate an analog signal at the terminal by rotating the parameter-select potentiometer to point a visible arrow at a visible color-coded dot representing the selected parameter, each of the parameters being represented by a color-coded dot fixed in relation to the parameter-select potentiometer;

converting the analog signal at the terminal into a digital signal in an analog-to-digital converter; and converting the digital signal into the four-bit address associated with the selected parameter in a digital signal processing circuit.

29. The method of claim 28, wherein adjusting the selected parameter further comprises:

detecting first pulses and second pulses generated by first or second rotations of a continuous digital potentiometer in a pulse detect circuit coupled to indicate the first pulses and second pulses to the digital signal processing circuit;

reading the pointer for the selected parameter from the EEPROM;

modifying the pointer to point to a value in the memory map for the selected parameter associated with the four-bit address by modifying the pointer to point to a next highest value each time a first pulse is detected and modifying the pointer to point to a next lowest value each time a second pulse is detected;

preventing the pointer from pointing to a value higher than the high value;

preventing the pointer from pointing to a value lower than the low value; and storing the pointer in the EEPROM when the parameter-select potentiometer is rotated to point the visible arrow at a new color-coded dot.

30. The method of claim 29, further comprising:

modifying the pointers to point to full-on values in the memory map for the parameters when the parameter-select potentiometer is rotated to point the arrow at a full-on parameters dot, the full-on values comprising a low cut filter frequency set for maximum gain, a high cut filter frequency set for maximum gain, a compression ratio set to 1:1, a threshold knee set to 45 dBSPL, and an output parameter set to maximum, the pointers to be modified according to full-on pointer data stored in the EEPROM; and modifying the pointers to point to best fit values in the memory map for the parameters when the parameter-select potentiometer is rotated to point the arrow toward a best fit parameters dot, the best fit values having been selected according to audiometric data or data for a typical user, the pointers to be modified according to best fit pointer data stored in the EEPROM.

31. The method of claim 21, wherein processing further comprises:

converting the input signal into a digital input signal in an analog-to-digital converter;

processing the digital input signal into a digital output signal in a digital signal processing circuit according to the parameters; and converting the digital output signal into the output signal in a digital-to-analog converter.

32. A hearing aid adapted to be worn in or about an ear, comprising:

a hearing aid housing;

a microphone to receive sound and to generate an input signal based on the sound;

a receiver in the housing to transmit sound from the hearing aid based on an output signal;

a first memory device in the housing to store first parameters, the first parameters including full-on parameters;

a second memory device in the housing to store second parameters;

a memory select device on an external surface of the housing to select the first parameters in the first memory device or the second parameters in the second memory device; and a signal processing circuit coupled between the microphone, the receiver, the first memory device, and the second memory device in the housing to process the input signal from the microphone and the output signal to be transmitted to the receiver according to the first parameters or the second parameters.

33. The hearing aid of claim 32, wherein the housing is adapted to be worn behind an auricle of the ear.

34. The hearing aid of claim 32, wherein the housing is adapted to be positioned in a concha of the ear.

35. The hearing aid of claim 32, wherein the housing is adapted to be positioned in an auditory canal of the ear.

36. The hearing aid of claim 32, wherein:

the first memory device comprises a first EEPROM; and the second memory device comprises a second EEPROM.

37. The hearing aid of claim 32, wherein the memory select device comprises a pushbutton toggle switch located on an external surface of the housing to generate a pulse when pushed.

38. The hearing aid of claim 32, wherein the signal processing circuit comprises a digital signal processing circuit.

39. The hearing aid of claim 32, wherein the signal processing circuit comprises:

a program connection to receive instructions to be programmed into the signal processing circuit;

an interface coupled to the program connection, the first memory device, and the second memory device to relay the instructions to the first memory device and the second memory device;

a processor coupled to the interface, the first memory device, and the second memory device to receive the instructions;

an analog-to-digital converter coupled between the microphone and the processor to convert the input signal from the microphone into a digital signal to be received by the processor;

a pulse detect circuit coupled between the memory select device and the processor to detect a pulse generated by the memory select device and to couple a signal to the processor indicating the detected pulse; and a digital-to-analog converter coupled between the processor and the receiver to convert a digital signal from the processor to the output signal to be received by the receiver.

40. The hearing aid of claim 32, wherein:

the microphone comprises a high terminal coupled to a supply voltage, a middle terminal to couple the input signal to the analog-to-digital converter, and a low terminal coupled to a ground voltage reference; and the receiver comprises two terminals coupled to the digital-to-analog converter to receive the output signal.

41. The hearing aid of claim 32, wherein:

the first memory device comprises the full-on parameters to cause the signal processing circuit to process the input signal from the microphone and the output signal to be transmitted to the receiver according to the full-on parameters when the first memory device is selected, the full-on parameters comprising a low cut filter frequency set for maximum gain, a high cut filter frequency set for maximum gain, a compression ratio set to 1:1, a threshold knee set to 45 dBSPL, and an output parameter set to maximum; and the second memory device comprises best fit parameters to cause the signal processing circuit to process the input signal from the microphone and the output signal to be transmitted to the receiver according to the best fit parameters when the second memory device is selected, the best fit parameters having been selected according to audiometric data or data for a typical user.

42. A method of operating a hearing aid adapted to be worn in or about the ear, the method comprising:

receiving sound in a microphone in a hearing aid housing and generating an input signal based on the sound;

selecting one of a first memory device in the housing in which first parameters are stored and a second memory device in the housing in which second parameters are stored with a memory select device on an external surface of the housing, the first parameters including full-on parameters;

processing the input signal into an output signal in a signal processing circuit coupled to the microphone, the first memory device, and the second memory device in the housing according to the first parameters or the second parameters selected by the memory select device; and generating sound in a receiver coupled to the signal processing circuit in the housing from the output signal.

43. The method of claim 42, wherein selecting comprises pushing a pushbutton toggle switch located on an external surface of the housing to generate a pulse.

44. The method of claim 42, wherein selecting further comprises selecting one of a first EEPROM in the housing in which the first parameters are stored and a second EEPROM in the housing in which the second parameters are stored with the memory select device.

45. The method of claim 42, further comprising:

processing the input signal according to the full-on parameters when the first memory device is selected by the memory select device, the full-on parameters comprising a low cut filter frequency set for maximum gain, a high cut filter frequency set for maximum gain, a compression ratio set to 1:1, a threshold knee set to 45 dBSPL, and an output parameter set to maximum.

46. The method of claim 45, further comprising processing the input signal according to best fit parameters when the second memory device is selected by the memory select device, the best fit parameters having been selected according to audiometric data or data for a typical user.

47. The method of claim 42, wherein processing further comprises:

converting the input signal into a digital input signal in an analog-to-digital converter;

processing the digital input signal into a digital output signal in a digital signal processing circuit according to the first parameters or the second parameters; and converting the digital output signal into the output signal in a digital-to-analog converter.

48. A hearing aid adapted to be worn in or about an ear, comprising:

a hearing aid housing;

a microphone to receive sound and to generate an input signal based on the sound;

a receiver in the housing to transmit sound from the hearing aid based on an output signal;

a first memory device in the housing to store first parameters;

a second memory device in the housing to store second parameters;

a memory select device on an external surface of the housing to select the first parameters in the first memory device or the second parameters in the second memory device; and a signal processing circuit coupled between the microphone, the receiver, the first memory device, and the second memory device in the housing to process the input signal from the microphone and the output signal to be transmitted to the receiver according to the first parameters or the second parameters, wherein the signal processing circuit comprises:

a program connection to receive instructions to be programmed into the signal processing circuit;

an interface coupled to the program connection, the first memory device, and the second memory device to relay the instructions to the first memory device and the second memory device;

a processor coupled to the interface, the first memory device, and the second memory device to receive the instructions;

an analog-to-digital converter coupled between the microphone and the processor to convert the input signal from the microphone into a digital signal to be received by the processor;

a pulse detect circuit coupled between the memory select device and the processor to detect a pulse generated by the memory select device and to couple a signal to the processor indicating the detected pulse; and a digital-to-analog converter coupled between the processor and the receiver to convert a digital signal from the processor to the output signal to be received by the receiver.

49. A hearing aid adapted to be worn in or about an ear, comprising:

a hearing aid housing;

a microphone to receive sound and to generate an input signal based on the sound, wherein the microphone comprises a high terminal coupled to a supply voltage, a middle terminal to couple the input signal to an analog-to-digital converter, and a low terminal coupled to a ground voltage reference;

a receiver in the housing to transmit sound from the hearing aid based on an output signal, wherein the receiver comprises two terminals coupled to a digital-to-analog converter to receive the output signal;

a first memory device in the housing to store first parameters;

a second memory device in the housing to store second parameters;

a memory select device on an external surface of the housing to select the first parameters in the first memory device or the second parameters in the second memory device; and a signal processing circuit coupled between the microphone, the receiver, the first memory device, and the second memory device in the housing to process the input signal from the microphone and the output signal to be transmitted to the receiver according to the first parameters or the second parameters.

* * * * *